United States Patent [19]

Svensson

[11] Patent Number: 4,932,647

[45] Date of Patent: Jun. 12, 1990

[54] METHOD AND APPARATUS FOR WITHDRAWING A SELECTED NUMBER OF CONSECUTIVE PRODUCTS SUCH AS NEWSPAPERS, FROM A SERIES OF SAID PRODUCTS TRAVELLING IN OVER-LAPPING FORMATION

[75] Inventor: Göte Svensson, Eksjö , Sweden

[73] Assignee: Wamac AB, Sweden

[21] Appl. No.: 303,490

[22] Filed: Jan. 27, 1989

[30] Foreign Application Priority Data

Jan. 28, 1988 [SE] Sweden ..... 8800268

[51] Int. Cl.[5] ..... B65H 29/04

[52] U.S. Cl. ..... 271/280; 271/176; 271/206; 414/796; 414/796.9; 414/798.9

[58] Field of Search ..... 271/280, 281, 204, 206, 271/176; 414/796, 796.9, 798.9

[56] References Cited

U.S. PATENT DOCUMENTS 4,004,694 1/1977 Sjogren .
4,566,687 1/1986 Faltin .
4,577,855 3/1986 Reist .
4,678,172 7/1987 Faltin ..... 271/202 X
4,720,091 1/1988 Kobler ..... 271/280 X

*Primary Examiner*—Richard A. Schacher
*Attorney, Agent, or Firm*—Ostrolenk, Faber, Gerb & Soffen

[57] ABSTRACT

In a method and apparatus for withdrawing a selected number of consecutive copies of newspapers, for instance, from a series of said products travelling horizontally and arranged in overlapping formation (4), a gripper (10) in the form of a mechanical clamp is caused to engage with the desired number of copies by the front edge of the clamp being kept in contact with the formation along a selected distance, the clamp being driven with a speed difference in relation to the formation such that a selected number of copies enter the clamp along the selected distance. At the end of the distance the clamp is closed and its speed thereafter accelerated in relation to the formation, to a speed considerably higher than that of the formation, its direction deviating only marginally from the direction of movement of the formation. Only a few consecutive copies are withdrawn from the formation so that no gaps occur in the formation.

6 Claims, 1 Drawing Sheet

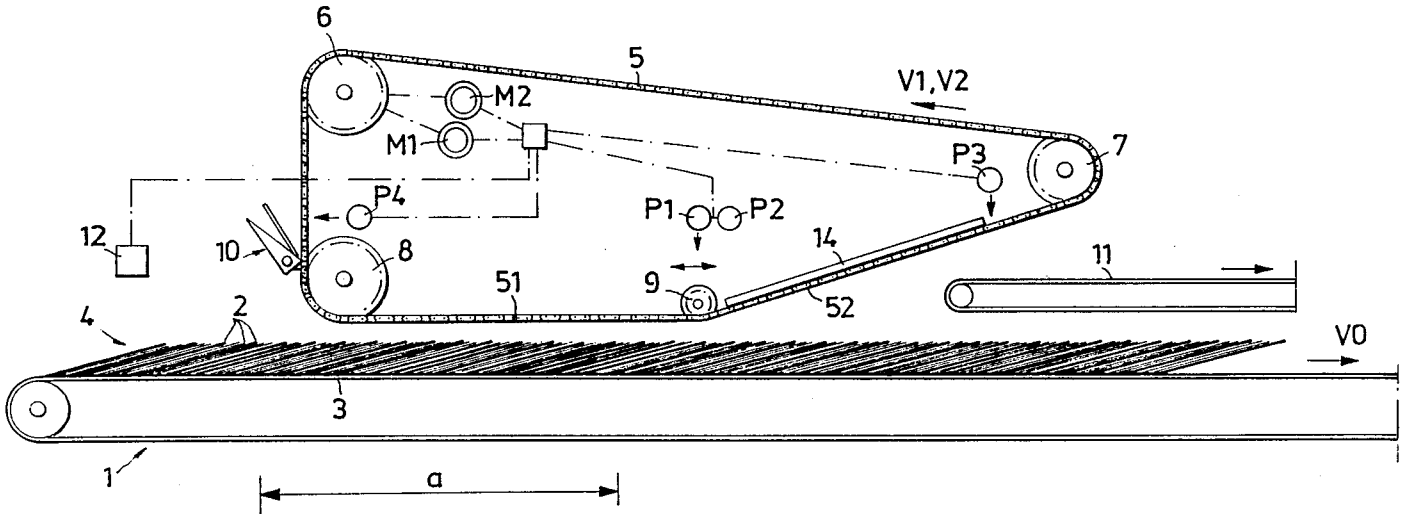
V0
11
7
V1, V2
P3
14
52
P2
P1
9
5
M2
51
M1
P4
8
6
10
2
12
4
3
1
a

METHOD AND APPARATUS FOR WITHDRAWING A SELECTED NUMBER OF CONSECUTIVE PRODUCTS SUCH AS NEWSPAPERS, FROM A SERIES OF SAID PRODUCTS TRAVELLING IN OVER-LAPPING FORMATION

The present invention relates to a method of withdrawing a selected number of consecutive flat products, such as newspapers, from a series of said products travelling in overlapping formation, wherein a gripping means is caused to engage with the desired number of products and withdraw this number from the formation. The invention also relates to an apparatus for performing the method.

In newspaper printing plants the newspapers produced at high speed are transported on conveyors in overlapping formation through various work stations for labelling, stacking, wrapping, putting into bundles and so on. Transportation and the various operations can only be performed if the overlap configuration is retained without significant disruption along the conveyors. However, it is important for supervisors to be able to withdraw copies of the newspaper from the formation soon after the printing cylinder, in order to check the quality and so on. The printing-roll may conventionally carry one or two printing plates and in the latter case it is advisable for two consecutive copies to be withdrawn from the formation. Since the noise level is high close to the printing machines, it is preferable for the samples to be withdrawn mechanically and conveyed to the sound-insulated area where the supervisors work.

Removing a number of successive copies from the formation, using mechanical means, has not entailed any major problems with the known technology. However, a first problem is caused by the disturbance in the structure of the formation resulting from removal of the samples, which has repercussions on subsequent work operations. Another problem is that, even if the structure of the formation is not disturbed by some copies of the products being turned askew or by displacement of the products within the formation, a relatively large number of copies (e.g. at least three or four consecutive copies) may easily be withdrawn from the formation by equipment known per se. The gaps thus formed may then cause formation disturbances at curves in the conveyor belt or at various mechanical interceptions in the formation.

One object of the invention is therefore to provide a simple, reliable technique allowing the removal of a selected few specimen of flat products from an overlapping formation of said products during transport, avoiding the occurrence of dislocations or gaps in the formation causing disturbances in operations to be carried out on the formation as it moves along.

This object is achieved in a method of the type mentioned in the introduction substantially by utilizing a clamp as gripping means, bringing the clamp into contact with the formation and moving said clamp along the formation at a selected speed, said speed being lower than that of the formation, in contact with the formation along a distance such that the clamp is caused to catch at most a predetermined maximum number of copies, thereafter causing the clamp to close, the closed clamp with the copies retained thereafter being accelerated to a speed considerably higher than that of the formation, its direction deviating only marginally from the direction of movement of the formation, so that the number of copies clamped is withdrawn from the formation with minimum disturbance to the structure of the formation.

An apparatus for performing the method comprises a gripping means and means causing said gripping means to engage with one or more products in the formation and for removing the clamped copies from the formation. The apparatus according to the invention is substantially characterised in that the gripping means is in the form of a clamp, that guide means are arranged to keep the front edge of the clamp in contact with the formation along a selected distance, said clamp being driven by drive means at a first speed selected in relation to the speed of the formation and the distance to cause a selected number of products to enter the clamp along said distance, that members are provided to close the clamp at the end of the distance, the driving means being arranged after said distance to cause the clamp to move with a speed considerably in excess of the speed of the formation, and that the guide means is arranged to guide the clamp in a direction deviating only marginally from the direction of movement of the formation after said distance, so that the product or products clamped is/are withdrawn from the formation with minimum disturbance to the structure of the formation.

One skilled in the art will understand that the technique of the invention can be developed by using conventional means to sense the positions of the transverse, upper, exposed edges of the products in the formation and to bring the front edge of the gripping clamp into contact with the formation in a previously selected position between the spines of consecutive newspapers. It can thus be ensured that the clamp will grip exactly the desired number of copies. In the absence of such means for setting the contact position of the clamp in relation to the edges of the products (newspapers), it may occasionally happen that the apparatus may only withdraw one copy although the intention was to withdraw two copies, and the apparatus was set for two copies. However, in such case the work cycle could be repeated and in all probability the apparatus would next time remove two copies (but not more!) from the formation. As mentioned, it is important to ensure that less than three consecutive copies are removed from the formation.

The clamps can be manipulated to open or closed position by means of cam arrangements known per se, and the clamp may be arranged on a continuous chain so that after each withdrawal operation it is returned to a starting position immediately prior to interception of the formation. It will also be understood that the clamp on the withdrawal means may be arranged to place the copy or copies it has withdrawn from the formation onto a conveyor which then conveys them to a point in the vicinity of where the products are checked for quality.

The invention will be described in more detail in the following, with reference to one embodiment by way of example.

The drawing shows schematically a side view of an apparatus according to the invention.

The drawing shows a conveyor 1, its upper, horizontal section 3 carrying newspapers 2 arranged in overlapping formation 4. The speed VO of the conveyor is preferably the same as that of the printing press on which the newspapers are produced, so that the newspapers are deposited on the conveyor 1 with constant spacing. Above the conveyor 1 is an apparatus for removing copies of the newspapers from the formation 4 during transportation on the conveyor 1. The apparatus comprises a continuous chain 5 running around three stationary deflection rolls 6, 7, 8 and a roll 9 displaceable along the conveyor 1. The section of the chain 5 extending between rolls 8 and 9 is substantially parallel to the conveyor section 3. The chain 5 is provided with a mechanical clamp 10. The chain 5 runs counter clockwise, the section 51 between rolls 8 and 9 thus running in the same direction as the conveyor section 3. One of the rolls, for instance roll 6, may be motor-driven, suitably by a low-speed motor M1 and a high-speed motor M2. When the chain 5 is driven by motor M1, the chain 5 runs at a speed V1 which may be approximately half of VO. The motor M2 is suitably arranged to drive the chain 5 at a speed V2, approximately twice VO.

The rolls 9 and 7 are so located that the chain section 52 between them extends substantially in the plane of the newspapers 2.

The mechanical clamp 10 may be provided with means 14 to close or open it at predetermined positions. The clamp 10 is shown in closing position P1 at the roll 9, the closing position P1 suitably following the horizontally adjustable roll 9. The opening position of the clamp 10 is marked P3 just upstream of the roll 7.

The clamp 10 can then be closed at P1 and be kept closed between P1 and P3 by a cam arrangement 14 which influences the clamp.

The clamp 10 may consist in known manner of one stationary and one movable collet jaw, the movable jaw being influenced by said cam 14 via a cam follower, not shown.

However, it must be obvious that the clamp 10 may be of any design and may be opened and closed by any form of suitable drive means.

The rolls 8 and 9 are located so that when the clamp 10 is within section 51 it is open towards the edges of the newspapers 2 travelling before it on the conveyor 1 and the following edge of the lower collet jaw rests on a newspaper 2 in the formation 4. Since the speed of the chain 5 is lower than that of the conveyor 1, one or more of the newspapers will run into the clamp 10 during section 51. When the clamp 10 reaches the roll 9, position P1, it will close, after which the motor M2 is activated so that the clamp holding the newspapers is accelerated to a speed V2 in a direction deviating only marginally from the direction defined by the longitudinal direction of the conveyor 1 and the inclination of the newspapers in the formation 4. The newspapers will therefore be withdrawn from the formation 4 causing minimum disturbance in the formation 4. When the closed clamp 10 with the newspapers 2 reaches the position P3, the clamp is opened, the newspapers are released and deposited onto a conveyor 11 to be carried away. Means are provided at position P3 which switch off the motor M2, the chain 5 thereafter being driven by the motor M1 until the clamp 10 reaches position P4, e.g. immediately upstream of the roll 8 where the motor M1 is switched off. Upon activation of the motor M1 the clamp 10 will be brought with negligible time delay into engagement with the formation 4 travelling its way. The distance a along which the clamp 10 picks up the newspapers is defined by the distance between the axes of rolls 8 and 9. Under normal practical circumstances, this pickup distance may be adjustable between 80 and 180 mm and is suitably equivalent to the newspaper spacing plus 20 mm if at least one copy is to be removed from the formation 4. If at least two copies are to be withdrawn the pickup distance should be equivalent to twice the newspaper spacing plus 20 mm. The distance between the axes of rolls 8 and 9 can of course be adjusted during operation in order to achieve withdrawal of the correct number of copies from the formation. As indicated at 12, a sensor may be arranged to sense the position of the edges of the newspapers 2 in the formation 4, permitting synchronization to such an extent that the lower, rear edge of the clamp 10 will always contact the formation 4 in a predetermined position between two consecutive newspaper spines when the apparatus is activated.

An expert will understand that if there is no sensing device 12 the apparatus may pick up two sample copies or none at all if it is set for picking up one copy.

If the aim is to withdraw one copy in a pickup operation, the pickup distance should be adjusted so that the apparatus picks out at least one copy. It may then sometimes withdraw two copies, but it will never miss. If at least two copies are desired, the pickup distance may be adjusted for at most three copies. However, the spacing should not be greater than one fourth of the length of the newspaper. The above values assume that the pickup distance is 20 mm plus the spacing between the spines of the newspapers when withdrawing at least one copy and 20 mm plus twice the spacing between the spines of the newspapers when withdrawing at least two copies.

An obvious advantage of the invention is that it allows the number of consecutive copies being withdrawn from the formation 4 at a pickup operation to be limited. This avoids gaps in the flow of newspapers, such gaps causing disturbances at curves in the conveyor and at mechanical interception points.

I claim:

1. A method of withdrawing a selected number of consecutive flat products, such as newspapers, from a series of said products travelling in overlapping formation, wherein a gripping means is caused to engage with the desired number of products and withdraw this number from the formation, c o m p r i s i n g utilizing a mechanical clamp as gripping means, bringing the clamp into contact with the formation and moving said clamp along the formation at a selected speed, said speed being lower than that of the formation, in contact with the formation along a distance chosen to cause the clamp to catch at most a predetermined maximum number of products, thereafter causing the clamp to close and retain the caught products, the closed clamp with the products thereafter being accelerated to a speed considerably higher than that of the formation, its direction deviating only marginally from the direction of movement of the formation so that the number of products clamped is withdrawn from the formation with minimum disturbance to the structure of the formation.

2. A method as claimed in claim 1, c o m p r i s i n g sensing the positions of the upper, exposed, transverse edges of the products in the formation and causing the clamp, when its front edge comes into contact with the formation, to engage in a predetermined position between consecutive edges.

3. A method as claimed in claim 1, comprising adjusting said distance in relation to the difference in speed between the formation and the clamp for withdrawing a selected number of products.

4. An apparatus for withdrawing a selected number of consecutive products, such as newspapers, from a series of said products travelling in overlapping formation, c o m p r i s i n g a gripping means (10) and means (5–9, M1, M2) causing said gripping means (10) to engage with one or more products (2) in the formation (4), w h e r e i n the gripping means (10) is in the form of a mechanical clamp, wherein guide means (8, 9) are arranged to keep the front edge of the clamp in contact with the formation (4) along a selected distance, said clamp (10) being driven by drive means (M1) at a first speed (V1) selected in relation to the speed (VO) of the formation and the distance (a) to cause a selected number of products to enter the clamp (10) along said distance (a), wherein members (14) are provided to close the clamp (10) at the end (P1) of the distance, the driving means (M2) being arranged after said distance (a) to cause the clamp (10) to move with a speed (V2) considerably in excess of the speed (VO) of the formation, and wherein the guide means (9, 7) is arranged to guide the clamp (10) in a direction deviating only marginally from the direction of movement of the formation (4) after said distance (a), so that the product or products clamped is/are withdrawn from the formation (4) with minimum disturbance to the structure of the formation.

5. An apparatus as claimed in claim 4, comprising sensing means (12) to guide the engaging edge of the clamp (10) to a predetermined position between consecutive product edges in an operating cycle.

6. An apparatus as claimed in claim 4, comprising a conveyor (11) to receive the products withdrawn from the formation and transport them to a previously selected destination.

* * * * *